US005868335A

United States Patent [19]

Lebrun

[11] Patent Number: 5,868,335

[45] Date of Patent: Feb. 9, 1999

[54] TISSUE ROLL DISPENSER

[76] Inventor: Camil Lebrun, 605 Rang Nord, Albanel, Québec, Canada, J8M 3L4

[21] Appl. No.: 925,667

[22] Filed: Sep. 9, 1997

[51] Int. Cl.[6] ..... B65H 19/00; B65H 16/06; B65H 18/04

[52] U.S. Cl. ..... 242/560.3; 242/596.2; 242/596.7; 242/596.8

[58] Field of Search ..... 242/560.3, 596.1, 242/596.2, 596.7, 596.8; 312/34.22

[56] References Cited

U.S. PATENT DOCUMENTS 2,751,162 6/1956 Bolger ..... 242/596.8

5,597,133 1/1997 Teague ..... 242/560.3

*Primary Examiner*—John Q. Nguyen

[57] ABSTRACT

A tissue roll dispenser provided with a pair of laterally slidable roll holding elements and with a longitudinally slidable roll releasing actuator is described herein. The roll holding elements are biased towards a roll holding position via a spring connected to both roll holding elements. The roll releasing actuator includes a pointed end provided with opposite lateral edges contacting a respective roll holding element. When the roll releasing actuator is moved from a resting position to an actuating position, the pointed end forces the roll holding elements to move laterally from a roll holding position to a roll releasing position.

10 Claims, 4 Drawing Sheets

TISSUE ROLL DISPENSER

FIELD OF THE INVENTION

The present invention generally relates to dispensers. More particularly, the present invention relates to a tissue roll dispenser.

BACKGROUND OF THE INVENTION

The prior art is replete with tissue roll dispensers provided with a housing configured and sized to contain two or more rolls of tissue. One of the rolls (hereinafter referred to as the primary roll) is maintained so that it is possible to unroll the tissue therefrom while the other rolls (hereinafter referred to as the secondary rolls) are in reserve and may take the place of the primary roll when it is exhausted. More specifically, when the primary roll is exhausted, a mechanism is manually actuated to release the exhausted roll to allow one of the secondary rolls to take its place and become the primary roll.

A first type of tissue roll dispenser is characterized by the pre insertion of spindles in individual rolls of tissue. These spindles, protruding from each end of the rolls, allow the rolls to be guided by tracks. U.S. Pat. No. 2,605,975 issued to Page et al. on Aug. 5, 1952; U.S. Pat. No. 2,727,930 issued to M°Cants on Oct. 23, 1956; and U.S. Pat. No. 3,865,295 issued to Okamura on Feb. 11, 1975 are examples of this type of dispenser.

A second type of dispenser is characterized by the absence of such spindle. This second type of dispenser has the advantage that the rolls are more easily inserted in the dispenser since no spindle has to be installed in the rolls. Dispensers of tissue rolls of this second type are however generally more mechanically complex, which increases the manufacturing costs and the maintenance costs and decreases the reliability of the dispenser. U.S. Pat. No. 2,896,871 issued to Woodruff on Jul. 28, 1959; U.S. Pat. No. 3,039,709 issued to Bolger on Jun. 19, 1962; U.S. Pat. No. 4,034,924 issued to Carlisle on Jul. 12, 1977; and U.S. Pat. No. 5,000,393 issued to Madsen on Mar. 19, 1991 are examples of such dispenser.

SUMMARY OF THE INVENTION

An object of the present invention is therefore to provide an improved tissue roll dispenser free of the above mentioned drawbacks of the prior art.

Another object of the invention is to provide a tissue roll dispenser of the above noted second type which is mechanically simple.

In the present disclosure and in the appended claims, the term "tissue roll" should be construed as meaning any roll formed of sheet material wound onto a hollow core, such as, for example, toilet paper rolls and paper towels rolls.

More specifically, in accordance with the present invention, there is provided a tissue roll dispenser for dispensing rolls of tissue provided with a hollow core, the dispenser comprising:

a frame having a longitudinal axis;

a housing so mounted to the frame as to form an enclosure configured and sized to receive at least one roll of tissue;

a pair of roll holding elements each provided with a respective projecting portion; each roll holding elements being so mounted to the frame that (I) the projecting portions face one another, and (ii) each roll holding element is laterally slidable between (a) a roll holding position where the projecting portions are separated by a first distance and (b) a roll releasing position where the projecting portions are separated by a second distance, the second distance being greater than the first distance; the projecting portions being configured to contact the hollow core of a tissue roll when the roll holding elements are in the roll holding position;

means for biasing the pair of roll holding elements towards the roll holding position;

a longitudinal roll releasing actuator including a first lateral edge contacting one of the roll holding element and a second lateral edge contacting the other of the roll holding element; the first and second lateral edges converging to form a generally wedge shape actuator end; the roll releasing actuator being so mounted to the frame as to be longitudinally and reciprocately movable between a resting position and an actuating position; wherein when the actuator is moved from the resting position to the actuating position the lateral edges contacting the roll holding elements cause the roll holding elements to slide from the roll holding position to the roll releasing position.

Other objects and advantages of the present invention will become more apparent to one skilled in the art upon reading of the following non restrictive description of a preferred embodiment thereof, given by way of example only with reference to the appended drawings.

DESCRIPTION OF THE PREFERRED EMBODIMENT

Figure 1:
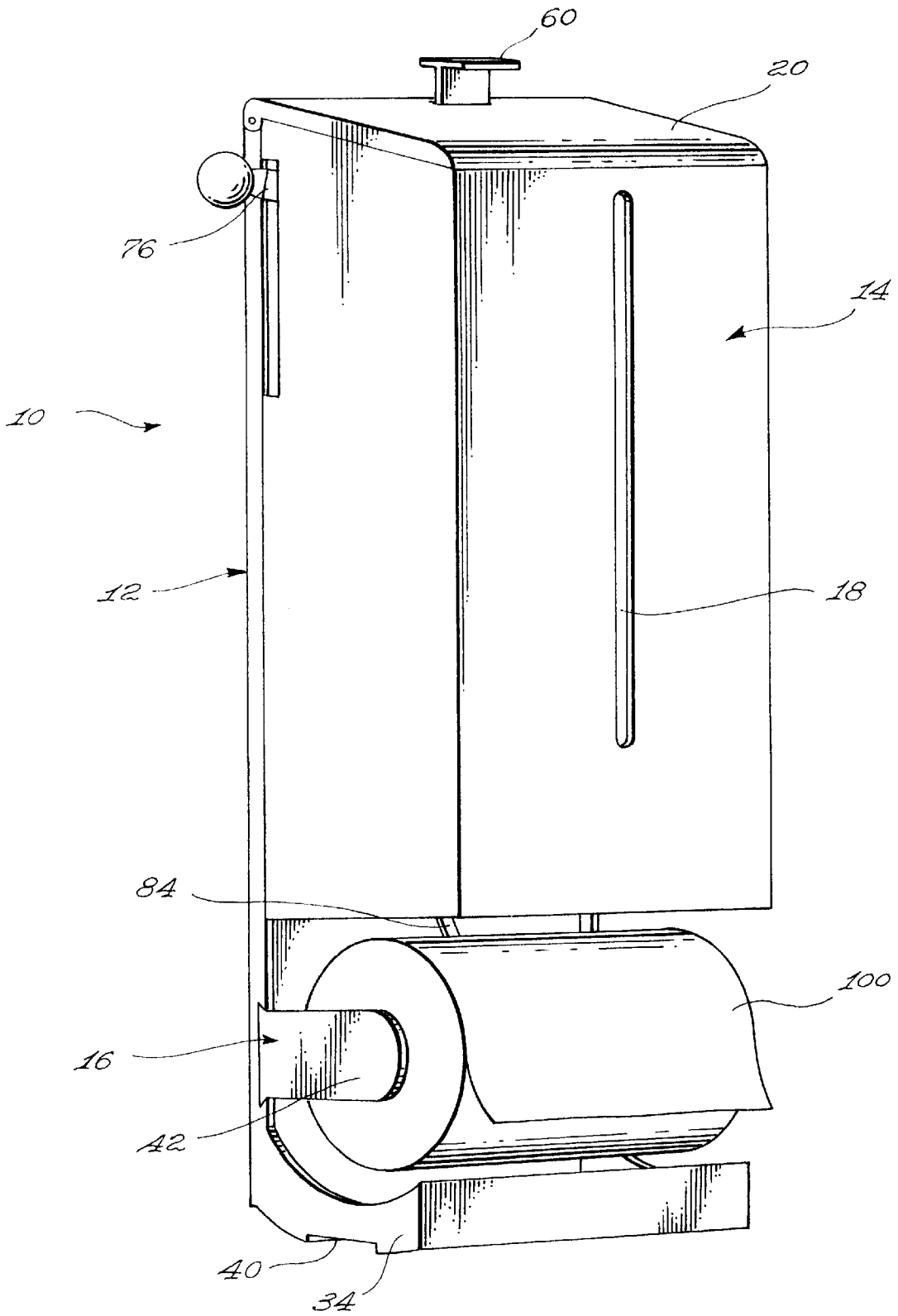
FIG. 1 illustrates, in a perspective view, a tissue roll dispenser according to an embodiment of the present invention.

Turning now to FIG. 1, a tissue roll dispenser 10 according to a preferred embodiment of the present invention will be described. The dispenser 10 includes a frame 12, a housing 14 removably mounted to the frame 12 and a roll retaining mechanism 16 mounted to the frame 12.

The housing 14 includes a longitudinal window 18 and a pivotable lid 20. As can be better seen from FIG. 2, the housing 14 may be removably mounted to the frame 12 via a plurality of hooks 22. The front wall 24 of the housing 14 is provided with first and second roll retaining projections 26, 28, fixedly mounted to the internal surface 30 of the front wall 24. The purpose of the projections 26, 28 will be described hereinafter.

Figure 2:
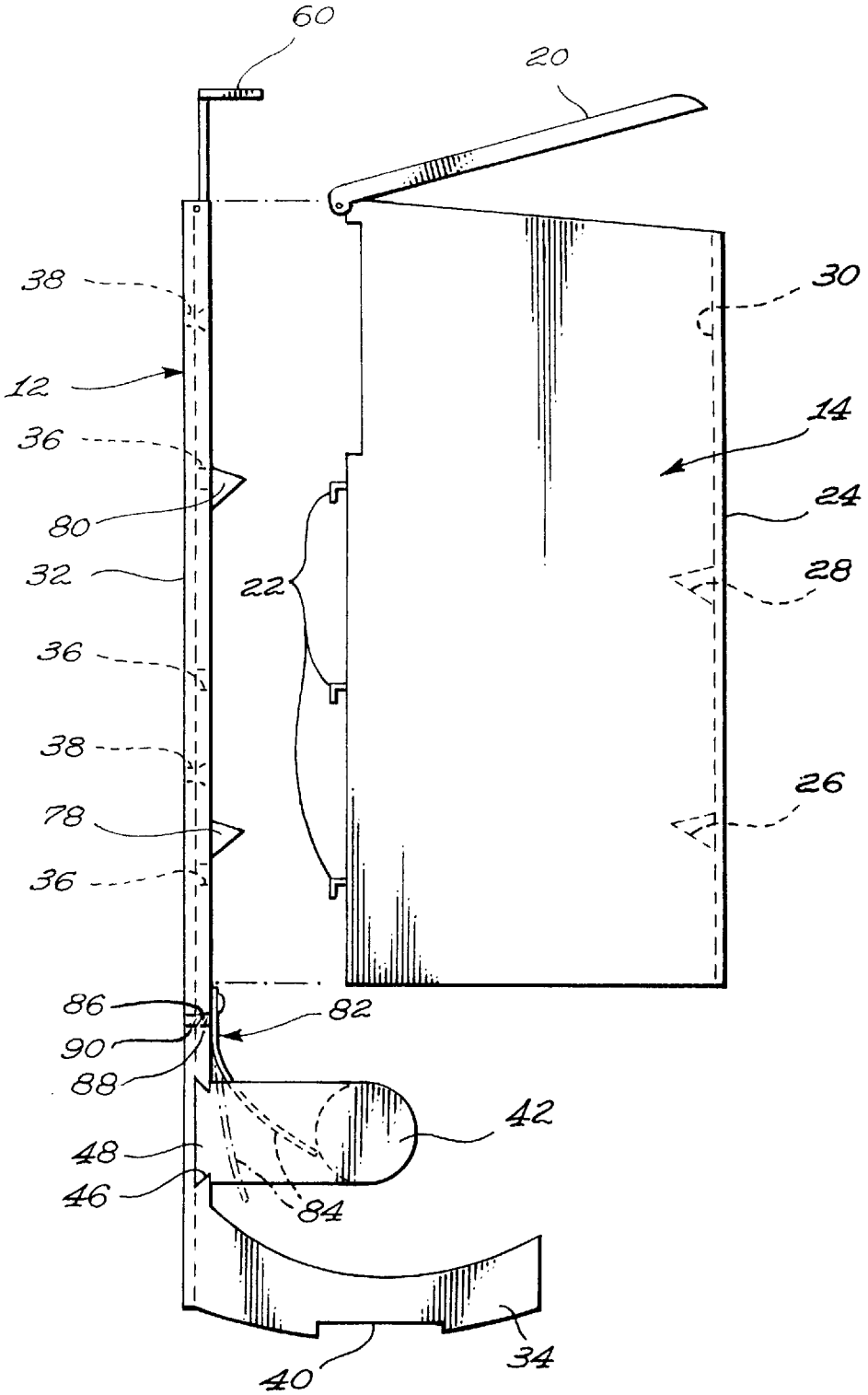
FIG. 2 illustrates a side elevations view of the tissue roll dispenser of FIG. 1 with the housing not mounted to the frame.

As can be seen from FIG. 2, the frame 12 includes a longitudinal frame element 32 and a lower frame element 34. The longitudinal frame element 32 includes a plurality of apertures 36 configured and sized to receive the hooks 22 of the housing 14, and apertures 38 configured and sized to receive conventional fasteners (not shown) to install the frame 12 to a wall, a partition or the like. The lower frame element 34 is fixedly mounted to the longitudinal frame element 32 and includes an aperture 40 configured and sized to allow a hollow core of an exhausted roll of tissue to pass through.

The roll retaining mechanism 16 includes a pair of roll holding elements 42, 44 so mounted to the longitudinal frame element 32 as to be laterally slidable. Indeed, the longitudinal frame element 32 includes a lateral channel 46 and each roll holding elements 42, 44 includes a projection 48 configured and sized to be slidably insertable in the lateral channel 46. It is to be noted that the shape of the channel 46 and of the corresponding projection 48 only allow lateral insertion of the projection 48 in the channel 46, thus preventing unwanted ejection of the projection 48 therefrom.

Figure 5:
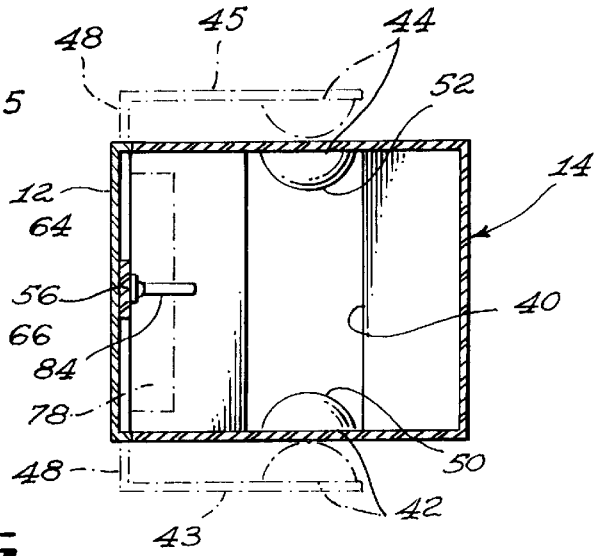
FIG. 5 illustrates a sectional view taken along line 5—5 of FIG. 3.

Each roll holding element 42, 44 includes a respective semi-spherical projecting portion 50, 52 mounted to a support arm 43, 45 itself mounted at right angle with the respective projection 48 (see FIG. 5). The projecting portions 50, 52 are configured and sized to enter the hollow core of a tissue roll when the roll holding elements 42, 44 are in the roll holding position.

Figure 4:
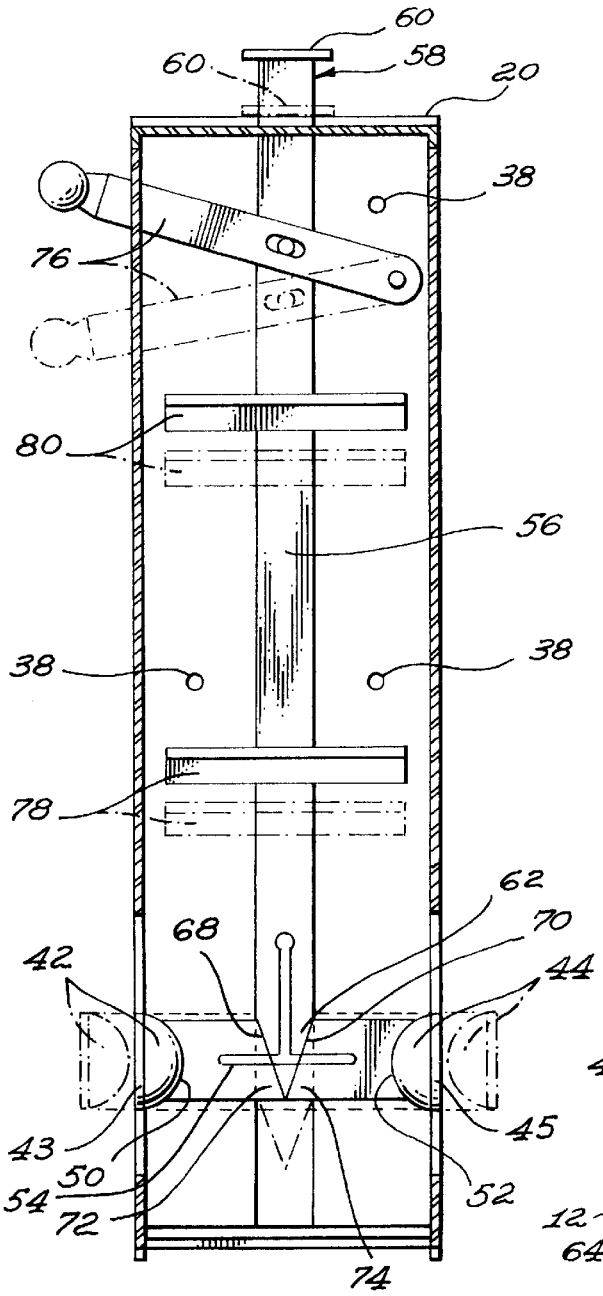
FIG. 4 illustrates a sectional view taken along line 4—4 of FIG. 3.

As can be seen from FIG. 4, the roll holding elements 42, 44 are reciprocately slidable between a roll holding position (shown in full lines) where the projecting portions 50, 52 are separated by a first distance and a roll releasing position (shown in dashed lines) where the projecting portions 50, 52 are separated by a second distance. The second distance being greater than the first distance.

A spring 54 is mounted between the roll holding elements 42, 44 to bias the roll holding elements towards one another, i.e. towards the roll holding position.

The roll retaining mechanism 16 further includes a roll releasing actuator 56 having a first end 58 provided with a handle 60 and a second pointed end 62. The actuator 56 is essentially flat and is slidably mounted in a longitudinal channel 64 (see FIG. 5) of the frame 12. It is to be noted that the shape of the channel 64 and of lateral edges 66 of the actuator 56 only allow longitudinal insertion of the actuator 56 in the channel 64, thus preventing unwanted ejection of the actuator 56 therefrom.

Figure 3:
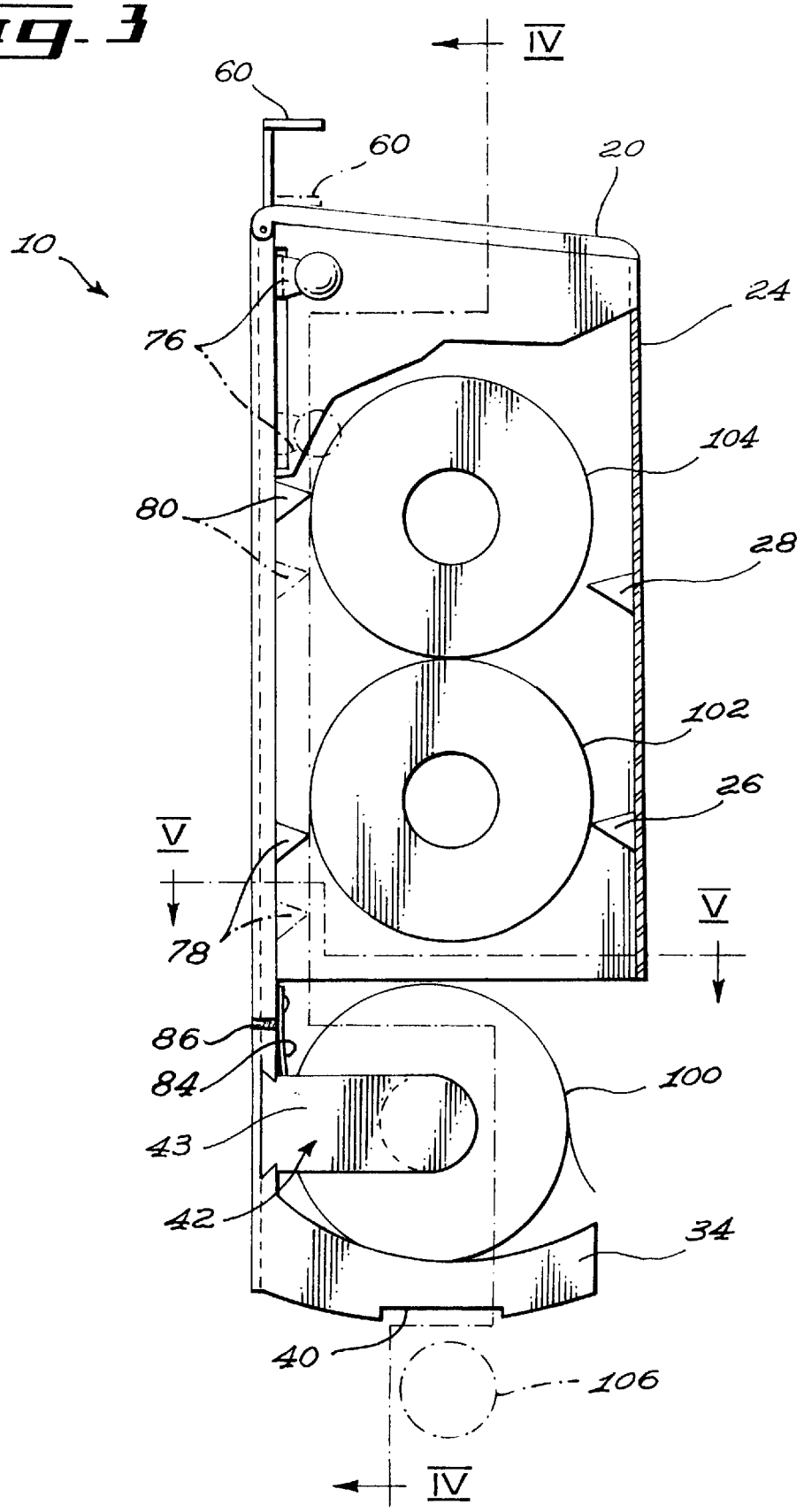
FIG. 3 illustrates a side elevations view of the tissue roll dispenser of FIG. 1 with the housing mounted to the frame and containing rolls of tissue.

As can be better seen from FIGS. 3 and 4, the roll releasing actuator 56 is reciprocately slidable in the channel 64 between a resting position (illustrated in full lines) and an actuating position (illustrated in dashed lines).

At the second pointed end 62 of the actuator 56, the lateral edges 68, 70 converge to form a point. The lateral edge 68 contacts an inner end 72 of the roll holding element 42 while the lateral edge 70 contacts an inner end 74 of the roll holding element 44. Therefore, when the actuator 56 is moved from the resting position to the actuating position the lateral edges 68, 70 cause the roll holding elements 42, 44 to laterally slide from the roll holding position to the roll releasing position.

The movement of the actuator 56 may be caused by a manual pressure exerted downwardly on the handle 60 or may be caused by a manual pressure exerted downwardly on an optional pivoting handle 76 which is pivotally mounted to the frame 12 and connected to the actuator 56 to change the pivotal movement of the handle 76 into an downward movement of the actuator 56. Of course, the manually applied force has to be sufficient to overcome the biasing force applied by the spring 54 if one wants to cause the roll holding elements 42, 44 to laterally slide from the roll holding position to the roll releasing position.

It is to be noted that when the manual pressure is no longer applied to one of the handles 60 or 76, the spring 54 biases the roll holding elements 42, 44, towards one another which causes the actuator 56 to move from its actuating position to its resting position. Of course, it is also possible to manually move the actuator 56 from its actuating position to its resting position via one of the handles 60 or 76.

The roll releasing actuator 56 also includes first and second roll retaining projections 78, 80, fixedly mounted to actuator 56 so as to slide therewith between the resting and the actuating positions.

As can be better seen from FIG. 3, when the actuator 56 is in the resting position (illustrated in full lines) the first roll retaining projection 78 is at approximately the same level as the first fixed roll retaining projection 26, while the second roll retaining projection 80 is higher than the second fixed roll retaining projection 28.

However, when the actuator 56 is in the actuating position (illustrated in dashed lines) the first roll retaining projection 78 is lower than the first fixed roll retaining projection 26, while the second roll retaining projection 80 is at approximately the same level as the second fixed roll retaining projection 28.

As will be easily understood by one of ordinary skill in the art, the configuration, the size and the position of the roll retaining projections 26, 28, 78 and 80 have been designed so that when the pair of first retaining projections 26, 78 or when the pair of second retaining projections 28, 80 are at the same level, they prevent a tissue roll to go down since the distance between the projections is less than the diameter of a tissue roll. Similarly, when the pair of first retaining projections 26, 78 or when the pair of second retaining projections 28, 80 are at different levels, they allow a tissue roll to go down since the distance between the projections is then more than the diameter of a tissue roll.

Returning to FIG. 2, the tissue roll dispenser 10 also includes a blocking mechanism 82 preventing the actuator 56 from being moved from its resting position to its actuating position when the primary tissue roll engaged between the roll holding elements 42, 44 is not exhausted. The blocking mechanism 82 includes a flexible sensing element 84 mounted to the actuator 56 and movable between a natural non blocking position (shown in full lines) and a blocking position (shown in dashed lines). The sensing element 84 is provided with a blocking pin 86 that is inserted in an aperture 88 of the actuator 56. The frame 12 includes a similar aperture 90 that is aligned with the aperture 88 when the actuator 56 is in the resting position. When the sensing element is in the blocking position, i.e. when a non exhausted tissue roll (not shown) is engaged between the roll holding elements 42, 44, the blocking pin 86 is pushed in the aperture 90, therefore preventing the actuator 56 to be longitudinally moved towards its actuating position. However, when the tissue roll engaged between the roll holding elements 42, 44 becomes exhausted, the flexible sensing element 84 is allowed to return to its natural, non blocking position and the blocking pin 86 is pulled from the aperture 90, therefore allowing the actuator 56 to be manually moved to its actuating position.

Turning now to FIG. 3 of the appended drawings, the operation of the tissue roll dispenser 10 will be described. As can be seen in this figure, a primary roll 100 is engaged between the roll holding elements 42, 44 and two secondary rolls 102, 104 are held in the housing 14, above the primary roll 100.

Since the primary roll 100 is maintained between the roll holding elements 42, 44, below the housing 14, the tissue forming the roll 100 is accessible to the user.

The secondary roll 102 is maintained at a predetermined distance from the roll holding elements 42, 44, above the primary roll 100 by the first roll retaining projections 26, 78 that are essentially at the same level. The secondary roll 102 does not contact the primary roll 100 which could cause unwanted friction resulting in unacceptable operation of the dispenser 10.

The second secondary roll 104 is in an abutting relationship with the first secondary roll 102 since the second roll retaining projections 28, 80 are not at the same level.

When the primary roll 100 is exhausted, only its hollow core 106 remains. Since the blocking mechanism 82 is then in a non blocking position, the actuator 56 may be pushed from its resting position (shown in full lines) to its actuating position (shown in dashed lines) via one of the handles 60, 76 as described hereinabove.

This position of the actuator 56 causes the roll holding elements 42, 44 to move from their roll holding position to their roll releasing position. The hollow core 106 is thus released from the roll holding elements 42, 44 and ejected through aperture 40 by gravity.

The first roll retaining projections 26, 78, being at different levels, the first secondary roll 102 is allowed to go down and to abut the lower frame element 34 to take the place of the exhausted primary roll 100. However, since the second roll retaining projections 28, 80 are then at essentially the same level, the second secondary roll 104 is not allowed to take the place of the first secondary roll 102.

When the actuator 56 is moved back from its actuating position to its resting position, the roll holding elements 42, 44 are moved back to their roll holding position, therefore engaging the roll 102 (not shown). It is to be noted that the semi-spherical shape of the projecting portions 50, 52 allow these projections to enter the hollow core of the roll 102 even if the roll 102 is not perfectly aligned therewith.

Since the second roll retaining projections 28, 80 are not longer at the same level, the second secondary roll 104 is allowed to go down (not shown) and take the place of the first primary roll 102.

Of course, the lid 20 may be opened to insert a new second secondary roll (not shown).

It is to be noted that the spring 54 could be replaced by other mechanism to bias the roll holding elements 42, 44 towards their tissue roll holding position such as, for example, a band of elastic material.

It is to be noted that even though the second end 62 of the actuator 56 is illustrated as being triangular, other wedge shapes could be used as long as it is configured to separate the roll holding elements 42, 44 as described hereinabove when the actuator is in its actuating position. Similarly the semi-spherical shape of the projecting portions 50, 52 is not essential and other shapes could be used, such as, for example, a frusto-conical shape.

Of course, if the tissue roll dispenser 10 is to be used in a public environment, a lock (not shown) may be provided to prevent unauthorized opening of the lid 20.

Finally, it is also to be noted that even though the housing 14 is illustrated in the appended figures as being configured to hold two secondary rolls of tissue, the housing 14 could be designed to hold any number of secondary rolls.

Although the present invention has been described hereinabove by way of a preferred embodiment thereof, this preferred embodiment can be modified at will, without departing from the spirit and nature of the subject invention as defined in the appended claims.

What is claimed is:

1. A tissue roll dispenser for dispensing rolls of tissue provided with a hollow core, said dispenser comprising:

a frame having a longitudinal axis;

a housing so mounted to said frame as to form an enclosure configured and sized to receive at least one roll of tissue;

a pair of roll holding elements each provided with a respective projecting portion; each said roll holding elements being so mounted to said frame that (I) said projecting portions face one another, and (ii) each roll holding element is laterally slidable between (a) a roll holding position where said projecting portions are separated by a first distance and (b) a roll releasing position where said projecting portions are separated by a second distance, said second distance being greater than said first distance; said projecting portions being configured to contact the hollow core of a tissue roll when the roll holding elements are in said roll holding position;

means for biasing said pair of roll holding elements towards said roll holding position;

a longitudinal roll releasing actuator including a first lateral edge contacting one of said roll holding element and a second lateral edge contacting the other of said roll holding element; said first and second lateral edges converging to form a generally wedge shape actuator end; said roll releasing actuator being so mounted to said frame as to be longitudinally and reciprocately movable between a resting position and an actuating position; wherein when said actuator is moved from said resting position to said actuating position said lateral edges contacting said roll holding elements to cause said roll holding elements to slide from said roll holding position to said roll releasing position.

2. A tissue roll dispenser as defined in claim 1, further comprising means for maintaining the at least one roll of tissue received in said housing at a predetermined distance from said roll holding elements.

3. A tissue roll dispenser as defined in claim 2, wherein said housing includes a front wall provided with an inner surface facing said frame; said maintaining means including a first fixed roll retaining projection mounted to said inner surface at said predetermined distance from said roll holding elements; said maintaining means also including a first movable roll retaining projection mounted to said movable roll releasing actuator; wherein when said roll retaining actuator is in said resting position said first fixed projection and said first movable projection are generally at the same level.

4. A tissue roll dispenser as defined in claim 3, wherein said housing is sized to receive at least two rolls of tissue, said maintaining means further comprising a second fixed roll retaining projection mounted to said inner surface at a predetermined distance from said first fixed roll retaining projection; said maintaining means also including a second movable roll retaining projection mounted to said movable roll releasing actuator; wherein when said roll releasing actuator is in said actuating position said second fixed projection and said second movable projection are generally at the same level.

5. A tissue roll dispenser as defined in claim 1, further comprising a blocking mechanism to prevent said roll releasing actuator from moving to said actuating position when a roll of tissue engaged between said pair of roll holding elements is not exhausted.

6. A tissue roll dispenser as defined in claim 5, wherein said blocking mechanism includes a flexible sensing element configured to contact the roll of tissue engaged between said pair of roll holding elements; said flexible sensing element being movable between a natural non blocking position and a blocking position; said flexible sensing element being configured and positioned so that (a) it is in a blocking position when a roll of tissue engaged between the pair of roll holding elements is not exhausted, and (b) it is in a non blocking position when a roll of tissue engaged between the pair of roll holding elements is exhausted.

7. A tissue roll dispenser as defined in claim 6, wherein said blocking mechanism also includes a blocking pin mounted to said flexible sensing element; said roll releasing actuator including a first aperture configured and sized to receive said blocking pin; said frame including a second aperture configured and sized to receive said blocking pin; said blocking pin being so mounted to said flexible sensing element as to enter both said first and second apertures when said flexible sensing element is in said blocking position.

8. A tissue roll dispenser as defined in claim 1, wherein said generally wedge shape actuator end is triangular.

9. A tissue roll dispenser as defined in claim 1, wherein said housing is provided with a pivotable lid.

10. A tissue roll dispenser as defined in claim 1, wherein said projecting portions of said roll holding elements are semi-spherical.

* * * * *